United States Patent [19]

Wilson

[11] 4,326,741

[45] Apr. 27, 1982

[54] DYE FILLED SECURITY SEAL

[75] Inventor: Dennis C. W. Wilson, Tijeras, N. Mex.

[73] Assignee: The United States of America as represented by the United States Department of Energy, Washington, D.C.

[21] Appl. No.: 170,253

[22] Filed: Jul. 18, 1980

[51] Int. Cl.[3] ..... B65D 33/34

[52] U.S. Cl. ..... 292/307 R

[58] Field of Search ..... 292/307, 315, 318, 327; 70/30

[56] References Cited

U.S. PATENT DOCUMENTS

| | | | |
|---|---|---|---|
| 602,129 | 4/1898 | Fisher | 292/215 |
| 1,553,188 | 9/1925 | Sauton | 292/318 |
| 2,610,879 | 9/1952 | Pope | 292/320 |
| 3,290,080 | 12/1966 | Dawson | 292/322 |
| 3,367,701 | 2/1968 | Wenk, Jr. | 292/321 |
| 3,463,532 | 8/1969 | Chidley et al. | 292/307 R |
| 3,881,759 | 5/1975 | Fuehrer | 292/321 |
| 3,991,594 | 11/1976 | Goenner | 70/30 |
| 4,093,288 | 6/1978 | Suzuki | 292/321 |
| 4,106,802 | 8/1978 | Lozio | 292/320 |

OTHER PUBLICATIONS

"Security Seal Handbook", Dec. 1978 by David Poli, SAND 78-0400.

*Primary Examiner*—Richard E. Moore

*Attorney, Agent, or Firm*—George H. Libman; Albert Sopp; Richard G. Besha

[57] ABSTRACT

A security seal for providing an indication of unauthorized access to a sealed object includes an elongate member to be entwined in the object such that access is denied unless the member is removed. The elongate member has a hollow, pressurizable chamber extending throughout its length that is filled with a permanent dye under greater than atmospheric pressure. Attempts to cut the member and weld it together are revealed when dye flows through a rupture in the chamber wall and stains the outside surface of the member.

8 Claims, 5 Drawing Figures

DYE FILLED SECURITY SEAL

BACKGROUND OF THE INVENTION

The present invention relates generally to security seals and more particularly to a security seal with dye that provides a visual indication when the seal has been broken. The United States Government has rights in the invention.

Security seals are often used to detect tampering with objects being shipped or stored. In a typical application the object is a container having a moveable cover, door or the like which is secured or locked in a conventional fashion and then sealed. Conventionally, the security seal consists of an elongate portion capable of being threaded through a hole in the object and restrained in place in such a manner that movement of the cover with respect to the container is impossible without removal of the elongate portion of the seal.

A security seal is not usually intended for use as a lock, i.e., it is not designed to withstand a physical assault. The seal is intended to provide an indication of an unauthorized opening of the object under seal. Accordingly, a security seal must be constructed such that it will be deformed when opened, thereby making it difficult to reassemble without leaving any sign of tampering on the seal.

Another feature of a security seal is its ability to be uniquely identified; i.e., its "fingerprint." The function of a seal would be defeated if it could be cut off and subsequently replaced with an identical seal. Accordingly, seals are often stamped with serial numbers or provided with random physical characteristics to make them unique. Although the instant invention is not directed to this feature of a seal, it should be understood that any known fingerprint technique could be utilized with the seals of the invention.

U.S. Pat. No. 3,717,369 to John Stoffel is an example of a typical seal of the plastic padlock type. With this seal, an elongate U-shaped shackle is hinged to a base member at one end and has an irregular shaped surface at the other end. In use, the shackle is placed through the object to be sealed and the irregular end of the shackle fitted into a hole in the base member. The hole contains spring fingers which interact with the irregular surface to prevent the shackle from being withdrawn from the base member without deformation of the seal.

Many other seal systems are described in "Security Seal Handbook" by David Poli, Sandia Laboratories, SAND 78-0440, December 1978 (available from NTIS, Springfield, VA 22161). These seals include crimp-/wire, cup/wire, plastic tie, car/plastic, fold/wire, wire hasp padlock, car/box end, car/ball end and cable as types of seals having a pliable elongated member; and bolt and lock as types of seals having a rigid elongated member. The elongate member for each of these seals is a solid piece of plastic or metal.

A method which may be employed to defeat each of the aforementioned seals is to cut and remove the elongate member and then replace it and weld the cut pieces together. Skilled welding and burnishing of the cut pieces can make detection of the unauthorized opening very difficult. This invention overcomes this inherent method of defeat of prior seals.

SUMMARY OF THE INVENTION

It is an object of this invention to provide a security seal that is not subject to defeat by cutting and welding the elongate member.

It is another object of this invention to provide a security seal that is similar in outward construction to, and utilized in similar manner as, prior seals.

Additional objects, advantages and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the security seal of this invention may comprise an elongate, hollow, thin-wall tubing having closed ends to form a pressurizable chamber extending the length of the tubing. The chamber contains a permanent dye for staining outer surfaces of the tubing. The elongated tubing is restrained within a hole in the object being protected by any available means or technique. If the seal is defeated by fracturing the elongate tubing, dye from the chamber stains the outer surface of the tubing forming a visual indication of the defeat. Since the dye penetrates the surface of the tubing it cannot be removed without destroying the seal.

BRIEF DESCRIPTION OF THE DRAWINGS

The accompanying drawings, which are incorporated in and form a part of the specification, illustrate some embodiments of the present invention and, together with the description, serve to explain the principles of the invention.

DETAILED DESCRIPTION OF THE INVENTION

Figure 1:
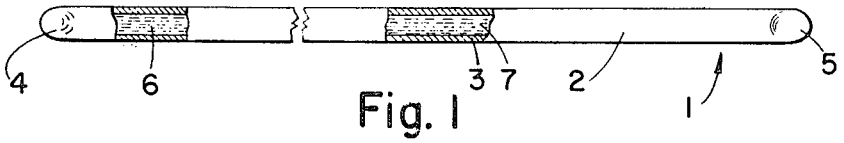
FIG. 1 shows the security sealing device of the invention.

FIG. 1 shows a security sealing device 1 in accordance with the invention including an elongate hollow tubing 2 having continuous thin wall 3 and opposed end portions 4 and 5 sealed to form pressurizable chamber 6 within tubing 2. Chamber 6 is filled with dye 7 for permanently and visibly staining the outer surface of tubing 2 if wall 3 is ruptured. Tubing 2 can typically be #1 gauge hollow core, semi-rigid steel wire and chamber 6 can be filled with any permanent, visible dye that penetrates the surface of the metal. One such dye is DyKem Blue (DyKem Co., St. Louis, MO), a dye conventionally used for fluoroscope processes. The dye 7 can be put in chamber 6 by any convenient technique such as applying a vacuum to end 4, supplying dye at end 5 and then crimping each end to seal the dye within the chamber. A small quantity of air or $CO_2$ is preferably added with the dye to pressurize the dye to about 3 pounds per square inch.

Figure 2:
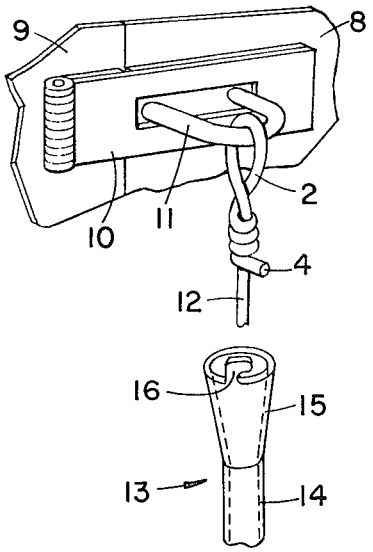
FIG. 2 shows the device of FIG. 1 secured through a hole by twisting one end portion around another portion and a tool for twisting this device.

As with all security seals, utilization of the device is dependent upon the object to be sealed. As shown in FIG. 2, a sealing operation typically involves two members capable of being moved from a first spaced position to a second adjoining position. Examples of such members are frame 8 and door 9 for a room where items are to be stored under seal. Door 9 is fitted with hasp 10 and frame 8 with associated loop 11 to provide conventional means wherein a padlock may be used to secure the door against the frame. For such a construction, security seal 1 is utilized by placing tubing 2 through loop 11 and twisting the portion near end 4 around a second portion 12 on the other side of the loop with tool 13 to prevent its removal without deformation of either the object or the sealing device. Tool 13 has hollow shaft 14, flared portion 15 and lug 16. In operation, after seal 2 is fit through loop 11 and bent such that the portion including end 4 is perpendicular to portion 12, tool shaft 14 is placed over seal portion 12 and lug 16 engaged with the perpendicular portion of the seal. When shaft 14 is rotated by suitable handle means (not shown), end portion 4 is wrapped around portion 12 of the seal in the manner illustrated. Of course, any other technique for wrapping the relatively stiff seal around itself may also be used.

The seal can obviously be easily removed by untwisting the wires. However, due to the stiffness or rigidity of the wire, attempts to replace it result in either the wire kinking in an obvious manner or rupturing, causing release of the dye as set forth hereinafter. In either event, it will be apparent upon inspection that the seal has been removed.

Figure 3:
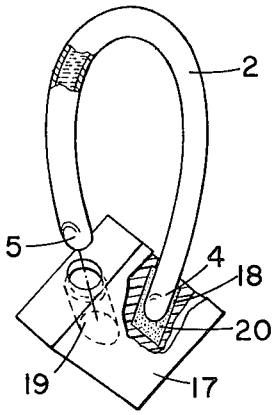
FIG. 3 shows the device of FIG. 1 with a typical means for restraining end portions of the tubing.

Another embodiment of security seal 1 which may be used is shown in FIG. 3. For this embodient tubing 2 is typically #2 gauge, hollow core, soft aluminum wire and chamber 6 is filled with a fluoroscope dye in the manner described above. This security seal is provided with means for restraining the tubing from removal from an object comprising a block 17 of brittle material such as resin, epoxy, acrylic or stressed glass. The block is provided with two, spaced holes 18 and 19 which receive ends 4 and 5, respectively, of tubing 2. In use, after tubing 2 has been positioned around the object to be sealed, ends 4 and 5 are fastened into holes 18 and 19 by quick setting epoxy 20. This seal may also be constructed with end 4 permanently fastened in hole 18 as illustrated.

Figure 4:
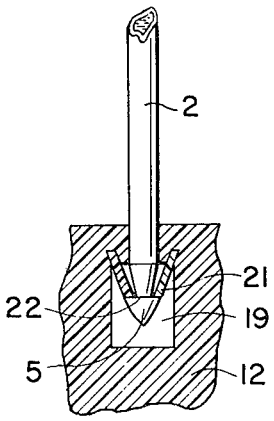
FIG. 4 shows a detail of the means of FIG. 3.

A portion of another version of block 12 which may be used with tubing 2 is shown in FIG. 4. Block 17 is equipped with at least one spring finger 21 in hole 19 for engagement with a flat surface 22 formed at the end 5 of tubing 2. When end 5 is placed in hole 19, attempts to remove finger 21 from surface 22 will cause block 15 to shatter.

Figure 5:
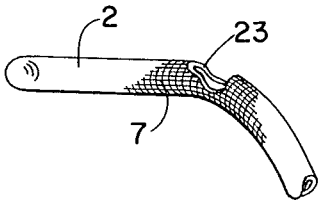
FIG. 5 shows a detail of the device of FIG. 1 after tampering.

This invention is particularly directed to detection of rupture 23 in wall 3 caused by cutting or bending tubing 2 after it has been sealed around an object. As shown in FIG. 5, after wall 3 is ruptured, dye 7 flows or exudes under pressure through rupture 23 to stain the outer surface of the tubing. Since dye 7 penetrates into the surface of tubing 2, it cannot be removed without obviously altering the shape of the tubing. Upon inspection, either the dye or the alteration of the tubing is easily detected.

Although only two embodiments of the security seal have been set forth, it must be understood that many other versions are contemplated. For example, the holes in block 17 may penetrate completely through the block, allowing it to be cinched up the tubing close to the object before being fastened in place. In addition, the hollow tubing of the invention may be used with rigid bolt seals, lock seals or any other seal utilizing a member extending through a hole in an object and fastened therein. A seal so constructed will provide easy, visible indication of an attempt to remove the seal by cutting the elongated member. It is intended that the scope of the invention be defined by the claims appended hereto.

I claim:

1. A security sealing device for providing visible indication of tampering or removal from an object to which it is secured comprising an elongate hollow thin-wall tubing for retention in a hole in the object and having two opposed ends for preventing removal from the hole or forceful deformation of said tubing without rupture of said wall, end portions of said tubing being closed to provide within the tubing a pressurizable chamber, and within the chamber a dye at greater than atmospheric pressure for permenently and visibly staining outer surfaces of said tubing upon rupture of said thin wall and exudation of dye from the chamber to said outer surfaces.

2. The security sealing device of claim 1 wherein said tubing consists of #1 gauge hollow core, semi-rigid steel wire, a portion of tubing near one of said ends being twisted around a second portion of tubing to fasten the device to the object.

3. The security sealing device of claim 2 wherein said chamber is filled with a metal penetrating dye under about 3 pounds per square inch pressure.

4. The security sealing device of claim 1 further including means connected to spaced portions of said tubing on either side of the hole for restraining the tubing from removal from the object.

5. The security sealing device of claim 4 wherein said tubing consists of #2 gauge hollow core, soft aluminum wire.

6. The security sealing device of claim 4 wherein said tubing comprises of #2 gauge hollow core, soft aluminum wire and said means for restraining comprises a brittle block having two spaced holes, one for each end of the tubing.

7. The security sealing device of claim 6 wherein an end of the tubing is restrained within a hole by epoxy.

8. The security sealing device of claim 6 wherein an end of the tubing is restrained within a hole by a spring member in the block.

* * * * *